United States Patent [19]

Nawata et al.

[11] Patent Number: 4,459,143

[45] Date of Patent: Jul. 10, 1984

[54] TEMPERATURE CONTROL METHOD FOR REVERSING TYPE HEAT EXCHANGER GROUP OF AIR SEPARATION SYSTEM

[75] Inventors: Makoto Nawata; Norio Nakazato; Sachihiro Yoshimatsu; Youichi Itou, all of Kudamatsu; Kengo Sugiyama, Abiko; Yasuo Tasaka, Kudamatsu, all of Japan

[73] Assignee: Hitachi, Ltd., Tokyo, Japan

[21] Appl. No.: 451,960

[22] Filed: Dec. 21, 1982

[30] Foreign Application Priority Data

Dec. 25, 1981 [JP] Japan ..... 56-209218

[51] Int. Cl.³ ..... F25J 3/04

[52] U.S. Cl. ..... 62/18; 55/33; 55/62; 55/74; 62/21

[58] Field of Search ..... 62/12, 13, 21, 37, 18; 55/31, 33, 62, 74, 75, 82, 179, 387, 389

[56] References Cited

U.S. PATENT DOCUMENTS

| | | | |
|---|---|---|---|
| 3,593,534 | 7/1971 | Seidel | 62/13 |
| 4,034,420 | 7/1977 | Gotoh et al. | 62/21 |
| 4,063,588 | 12/1977 | Thorogood | 62/13 |

FOREIGN PATENT DOCUMENTS 11481 4/1972 Japan .

*Primary Examiner*—Frank Sever

*Attorney, Agent, or Firm*—Antonelli, Terry & Wands

[57] ABSTRACT

A temperature control method for a reversing type heat exchanger group wherein an outlet temperature of reheating gas of an arbitrarily selected reversing type heat exchanger which serves as a reference in the reversing heat exchanger group is rendered equal in value to a reference control temperature set beforehand in such a manner so as to satisfy the sweeping temperature difference. The outlet temperatures of the reheating gas in the other reversing type heat exchangers of the reversing type heat exchanger group are rendered equal in value to the outlet temperature of the reheating gas in the reversing type heat exchanger serving as the reference. Thus, the temperature of the cold end of all of the reversing type heat exchangers of the reversing type heat exchanger group are caused to be balanced equally whereby ice and dry ice deposited on the feed water channels can be effectively removed by a sweeping action.

3 Claims, 7 Drawing Figures

TEMPERATURE CONTROL METHOD FOR REVERSING TYPE HEAT EXCHANGER GROUP OF AIR SEPARATION SYSTEM

FIELD OF THE INVENTION

This invention relates to a temperature control method for a reversing type heat exchanger group of an air separation system suitable for stably operating the reversing type heat exchanger group including at least two heat exchangers arranged parallel to each other.

DESCRIPTION OF THE PRIOR ART

Figure 1:
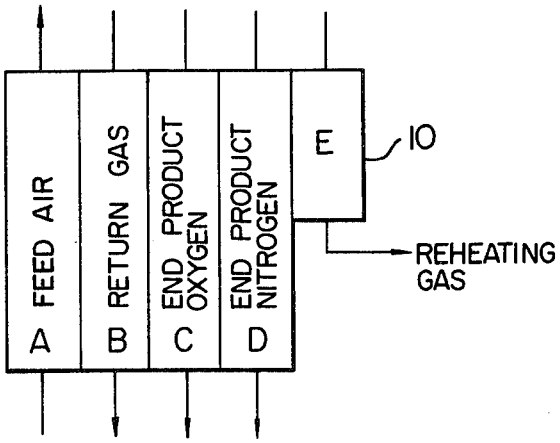
FIG. 1 PRIOR ART
FIG. 1 is a schematic view of a prior art reversing type heat exchanger of an air separation system.

Referring now to the drawings wherein like reference numerals are used throughout the various views to designate like parts and, more particularly, to FIG. 1, according to this figure, feed air fed into an air separation system, not shown, and return gas discharged from the air separation system flow in a predetermined direction through the channels A and B which are cyclically switchable; with gases separated from the feed air at the air separation system or end product oxygen and end product nitrogen flowing in a predetermined direction through the channels C and D; and reheating gas flowing in a predetermined direction through the channel E.

The feed air flowing through the channel A, for example, is cooled by heat exchange with the end product oxygen and the end product nitrogen flowing through the channels C and D, respectively, so that the water content of the feed air and the carbon dioxide therein are deposited on the heat transfer surface of the channel A. The ice and dry ice deposited on the heat transfer surface are sublimated and removed by sweeping by the return gas flowing through the channel A when flow switching is effected next time.

Figure 2:
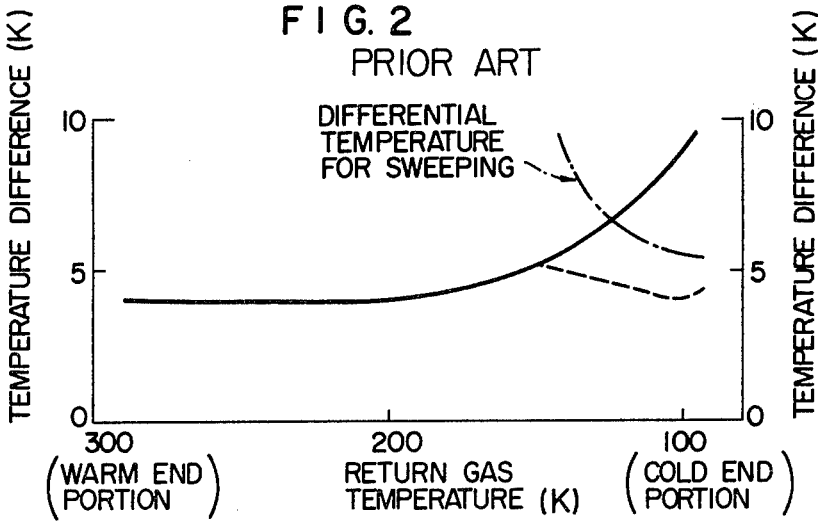
FIG. 2 PRIOR ART
FIG. 2 is a diagrammatic representation of the temperature of the return gas and the temperature difference between a feed air and the return gas in various sections of the heat exchanger in relationship to a differential temperature for sweeping.

To effectively sweep and remove the ice and the dry ice deposited on the heat transfer surfaces of the channels A and B switched in cycle, particularly the dry ice, by using the return gas, it is necessary that the temperature difference between the feed air and the return gas be below a temperature difference high enough to effect removal of the dry ice through sublimation by sweeping. As shown in FIG. 2, the temperature difference between the feed air and the return gas tends to increase in a reversing type heat exchanger in going from its warm end section to its cold end section as indicated by a solid line. When the return gas has its temperature drop to a level below about 125 K., the temperature difference between the feed air and the return gas rises above the differential temperature for sweeing as indicated by a dash-and-dot line in FIG. 2 in a region from the temperature drop section to the cold end section, resulting in the dry ice being removed unsatisfactorily by sweeping. To obviate this defect, reheating gas is passed through the channel E to cause the temperature difference between the feed air and the return gas to drop below the differential temperature for sweeping as indicated by a broken line in FIG. 2. Generally a portion of the feed air cooled by the reversing type heat exchanger 10 is used as reheating gas. End product gas, impure nitrogen gas and other process gases separated by the air separation system may also be used as reheating gas.

Figure 3:
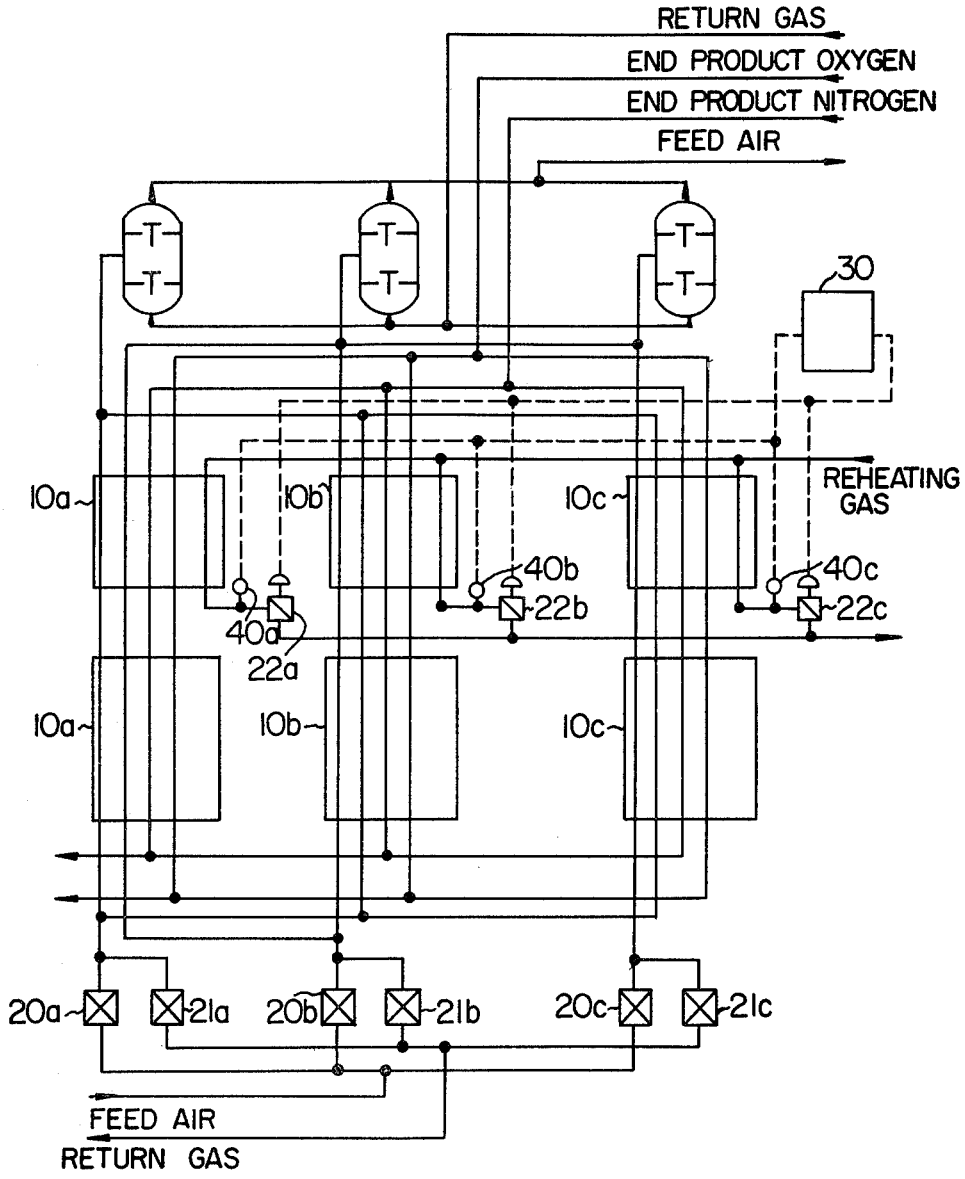
FIG. 3 PRIOR ART
FIG. 3 is a flow sheet of a reversing heat exchanger group of an air separation system in which the temperature control method of the prior art is carried out under practice.

In an air separation system, at least two reversing type heat exchangers are arranged in parallel with each other as shown in FIG. 3. Even if production is carried out in accordance with the same specifications in all the reversing type heat exchangers, it is inevitable that there are differences in fluid resistance between the heat exchangers. There are also differences in fluid resistance between lines connecting the heat exchangers together or between valves mounted in such lines, causing unbalance to occur in the distribution of the flow rates of fluids. This inevitably causes unbalance of temperature to occur in various sections of the reversing type heat exchangers. When this occurs, it would be impossible to carry out operation of the group of reversing type heat exchangers in a stable manner because a specific heat exchanger or exchangers would be overcooled. Thus, it would be necessary, to avoid this phenomenon, to effect control of the temperature of the reversing type heat exchanger group in an optimum manner to prevent the occurrence of unbalance in temperature in various sections of each reversing type heat exchanger.

Temperature control of the reversing type heat exchanger group has been carried out as follows.

Referring to FIG. 3, the temperature of the reheating gas is sensed at the same section except for reheating gas inlet sections of reversing type heat exchangers 10*a*–10*c* or the reheating gas outlet temperatures of the reversing type heat exchangers 10*a*–10*c* are sensed by temperature sensors 40*a*–40*c* each time the channels thereof are switched by actuating switching valves 20*a*–20*c* or switching valves 21*a*–21*c*. The temperatures sensed replace the temperatures stored in a control device 30. At the same time, an arbitrarily selected reversing type heat exchanger of the reversing type heat exchanger group or the reversing type heat exchanger 10*a* is selected and its reheating gas outlet temperature is used as a reference control temperature to control by signals from the control device 30 the degree of opening of flow rate control valves 22*b* and 22*c* to effect control of the flow rate of the reheating gas flowing through the reversing type heat exchangers 10*b* and 10*c*, so as to bring the reheating gas outlet temperatures of the reversing type heat exchangers 10*b* and 10*c* into agreement with the reference control temperature. For example, when the reheating gas outlet temperatures of the reversing type heat exchangers 10*b* and 10*c* are higher than the reference control temperature, control of the flow rate of the reheating gas is effected in such a manner that the flow rate thereof is increased. Conversely when the reheating gas outlet temperatures are lower, control is effected in a manner so as to reduce the flow rate of the reheating gas.

Although the temperature control method for the reversing type heat exchanger group outlined hereinabove is capable of controlling the reheating gas outlet temperatures of the reversing type heat exchanger group in a manner to obtain balancing thereof, the method suffers the following disadvantages.

(1) In the method described, the temperatures of the reversing type heat exchanger group are made to balance by using only the temperature of the reheating gas at the same cross section except for the temperature at the reheating gas inlet sections of the reversing type heat exchangers irrespective of the temperature difference between the feed air outlet temperature and the return gas inlet temperature of the reversing type heat exchangers (hereinafter called temperature difference of cold end). Because of this, the dry ice might not be removed effectively by sweeping by the return gas. Stated differently, in the reversing type heat exchanger or exchangers of the reversing type heat exchanger group in which the temperature difference of cold end is too high to satisfy the differential temperature for sweeping, the temperature difference between the feed gas and the return gas at the same cross section of the cold end section of the reversing type heat exchanger shown in FIG. 4 in a solid line becomes higher than the differential temperature for sweeping shown in FIG. 4 in a dash-and-dot line, thereby making it impossible to obtain stable operation of the reversing type heat exchanger group. Conversely, when the temperature difference of cold end of the reversing type heat exchangers is low, the temperature difference between the feed air inlet temperature of the warm end section of the reversing type heat exchanger and the outlet temperature of the return gas and separated gases or end product oxygen and end product nitrogen (hereinafter called temperature difference of warm end) becomes high. This would make it impossible to recover the heat satisfactorily and also result in the temperature difference between the feed air and the return gas becoming high at the same cross section of the intermediate sections of the reversing type heat exchangers, giving rise to a portion in which the feed air-return gas temperature difference becomes higher than the differential temperature for sweeping as indicated by a broken line in FIG. 4. When this is the case, it would be impossible to effect dry ice removal satisfactorily, resulting in stable operation of the reversing type heat exchanger group being unobtainable. This shows that an optimum differential temperature for sweeping exists to enable the temperature difference of cold end of the reversing type heat exchangers to satisfy the differential temperature for sweeping and make it possible to recover the heat satisfactorily.

Figure 5:
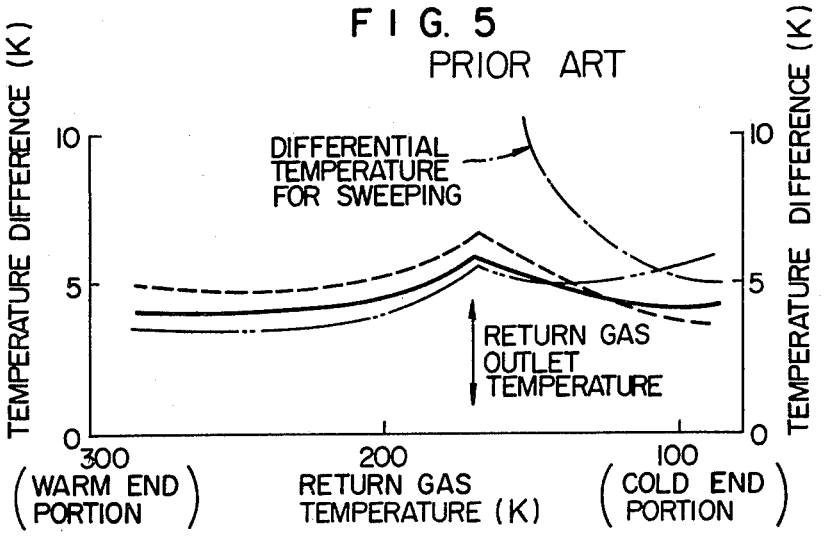
FIG. 5 PRIOR ART
FIG. 5 is a diagrammatic representation of the relationship between the temperature of the return gas and the temperature difference between the feed air and the return gas in various sections of the reversing type heat exchangers of a heat exchanger group in which the outlet temperature of the reheating gas is an equilibrium and the temperature difference of the cold end or temperature difference of the warm end is different.

(2) Even if control of the reversing type heat exchanger group is effected as shown in FIG. 5 to obtain balancing of the reheating gas outlet temperatures, unbalance of the distribution of the flow rate would occur in the reversing type heat exchanges due to fluid resistance and other factors, so that it would be impossible to obtain balancing of the temperature differences of cold end and the temperature differences of warm end of the reversing type heat exchangers. Stated differently, even if the reheating gas outlet temperatures of the reversing type heat exchangers are controlled in a manner so as to be balanced, there are possibilities that the differential temperature for sweeping would not be satisfied in some reversing type heat exchangers. In the event that some reversing type heat exchanger or exchangers do not satisfy the differential temperature for sweeping, then it would be difficult for such heat exchangers to effect removal of the dry ice satisfactorily. As a result, it would be impossible to obtain stable operation of the reversing type heat exchanger group. Also even if the differential temperature for sweeping is satisfied in each reversing type heat exchanger, there are possibilities that the temperature difference of cold end and the temperature difference of warm end are unbalanced in the reversing type heat exchangers. This would give rise to the problem of having adverse effect on the recovery of the heat and operation of the air separation system.

SUMMARY OF THE INVENTION

This invention has as its object the provision of a temperature control method for a reversing type heat exchanger group of an air separation system capable of obtaining stable operation of the air separation system continuously by effecting temperature control of the reversing type heat exchanger group to obtain heat balance and effectively removing the water content of the feed air and impurities therein, such as carbon dioxide, from the feed air.

According to the invention, there is provided a temperature control method for a reversing type heat exchanger group of an air separation system, wherein in an arbitrarily selected reversing type heat exchanger of the reversing type heat exchanger group which serves as a reference for temperature control, a reference control temperature which is a reheating gas outlet temperature of the reversing type heat exchanger in which a temperature difference of cold end or a temperature difference of warm end is set to satisfy the differential temperature for sweeping between the temperature of feed air and the temperature of return gas, is compared with a reheating gas outlet temperature sensed in the reversing type heat exchanger serving as a reference, and the flow rate of the reheating gas of the reversing type heat exchanger serving as the reference is adjusted to bring the reheating gas outlet temperature into agreement with the reference control temperature. In the other reversing type heat exchangers, the reheating gas outlet temperature sensed in the reversing type heat exchanger serving as the reference which serves as a control target temperature is compared with reheating gas outlet temperatures sensed in other reversing type heat exchangers and adjustments of the flow rate of the reheating gas in other reversing type heat exchangers is effected in such a manner that the reheating gas outlet temperatures are brought into agreement with the control target temperature, to thereby obtain balancing of temperature in the reversing type heat exchanger group and effectively remove ice and dry ice deposited on a feed air channel by sweeping. The temperature difference of cold end or the temperature difference of warm end of each reversing type heat exchanger of the reversing type heat exchanger group is sensed according to the invention, and the reference control temperature is varied in such a manner that the temperature difference of cold end of the reversing type heat exchanger in which the temperature difference of cold end is maximized or the temperature difference of cold end of the reversing type heat exchanger in which the temperature difference of warm end is minimized is brought to an optimum differential temperature for sweeping, and the flow rate of separated gases or the flow rate of the feed air for each reversing type heat exchanger is adjusted in such a manner that the temperature differences of cold end or temperature differences of warm end of the reversing type heat exchangers agree with one another, to thereby enable the heat to be efficiently recovered while obtaining stable operation of the reversing type heat exchanger group of the air separation system.

DESCRIPTION OF THE PREFERRED EMBODIMENT

Figure 6:
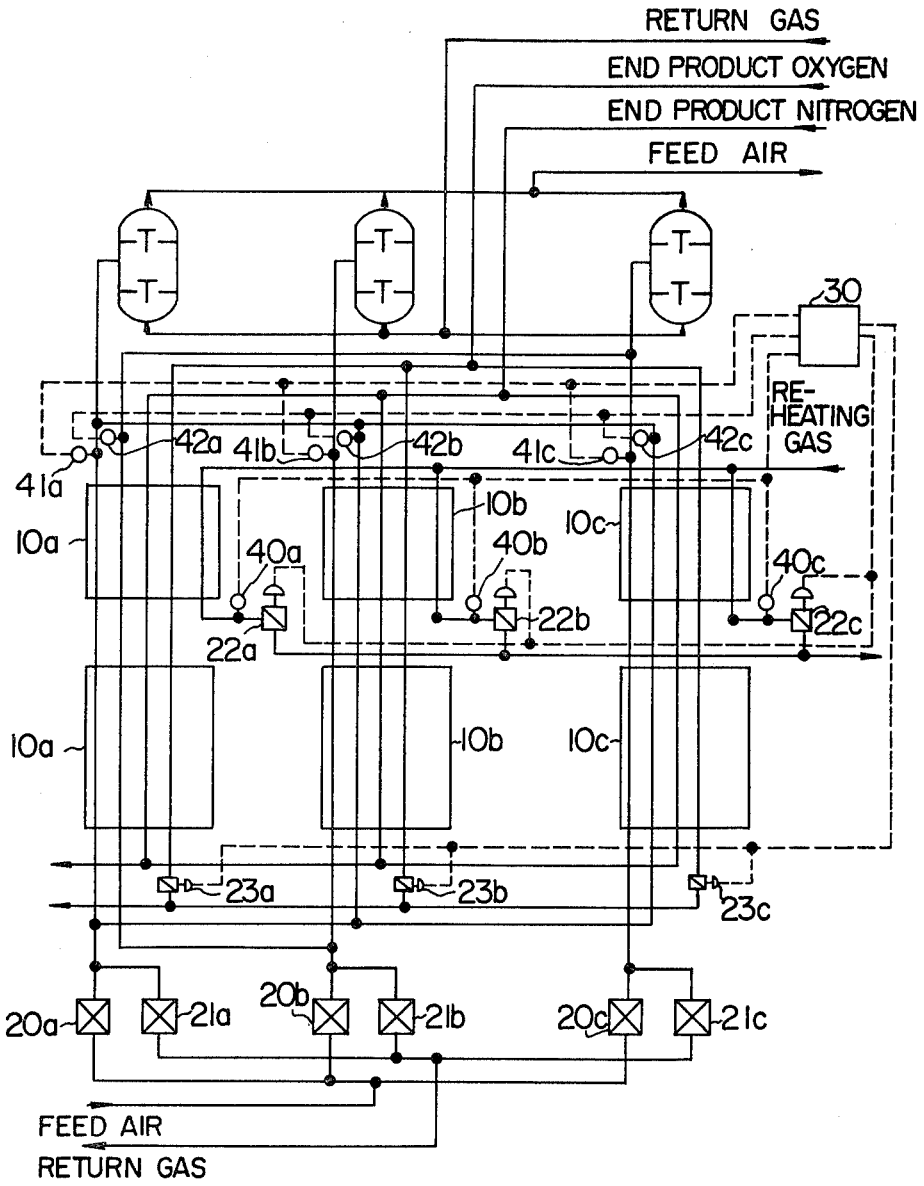
FIG. 6 is a flow sheet of a reversing type heat exchanger group of an air separation system in which the temperature control method according to the present invention is carried into practice.

In FIG. 6 outlet temperatures of reheating gas of reversing type heat exchangers 10*a*–10*c* are sensed by temperature sensors 40*a*–40*c* each time the channels of the reversing type heat exchangers 10*a*–10*c* are switched. Outlet temperature of feed air and inlet temperatures of return gas are sensed by temperature sensors 41*a*–41*c* and 42*a*–42*c* respectively at a rate of once for switching of the channels for a number of times. The values of the temperatures sensed by these temperature sensors are supplied to a control device 30 to replace values of the temperature stored therein. Temperature control of the reversing type heat exchanger group 10*a*–10*c* is carried out as follows.

First, a reversing type heat exchanger serving as a reference for temperature control (hereinafter called a reference heat exchanger) is arbitrarily selected from among the reversing type heat exchangers 10*a*–10*c*. Assume that the reversing type heat exchanger 10*a* is selected as the reference heat exchanger. Then in the reversing over type heat exchanger, an outlet temperature of reheating gas sensed to replace the reheating gas outlet temperature stored in the control device 30 is compared with an arbitrarily set outlet temperature of the reheating gas (hereinafter called reference control temperature) at which the temperature difference of cold end satisfies sweeping requirements by the control device 30 which adjusts the degree of opening of a flow rate control valve 22*a* to effect adjustments of the flow rate of the reheating gas to thereby bring the sensed outlet temperature of the reheating gas into agreement with the reference control temperature. When the outlet temperature of the sensed reheating gas is higher than the reference control temperature, for example, the flow rate of the reheating gas is increased, and when it is lower than that the flow rate is reduced. At the same time, in other reversing type heat exchangers 10*b* and 10*c* which use the outlet temperature of the reheating gas sensed for the reversing type heat exchanger 10*a* as a control target temperature, outlet temperatures of reheating gas sensed for the reversing type heat exchangers 10*b* and 10*c* replace the outlet temperatures stored in the control device 30 is compared with the control target value by the controol device 30. The control device 30 adjusts the degree of opening of flow rate control valves 22*b* and 22*c* to adjust the flow rate of the reheating gas to bring the sensed outlet temperatures of the reheating gas of the reversing type heat exchangers 10*b* and 10*c* into agreement with the control target temperature. When the outlet temperature of the reheating gas of the reversing type heat exchanger 10*b* that is sensed is higher than the control target temperature, for example, the flow rate of the reheating gas flowing through the reversing type heat exchanger 10*b* is increased. Conversely when it is lower, the flow rate is reduced. In this way, control of the outlet temperatures of the reheating gas in the reversing type heat exchanger group can be effected in a manner to obtain balancing of the temperatures.

The flow rates of fluids flowing through the reversing type heat exchanger group show variations due to the flow resistance in the channels, so that the cold end temperature of the reversing type heat exchangers may deviate from the range of allowable values of the temperature difference of cold end (hereinafter called cold end allowable values) in which the temperature difference of cold end exceeding the temperature for sweeping is set as an upper limit and the temperature difference of cold end is set as a lower limit when the temperature difference between the feed air and the return gas in the intermediate section of the reversing type heat exchanger exceeds the differential temperature for sweeping. When the temperature differences of cold end sensed by the temperature sensors 41*a*, 41*b*, 41*c*, 42*a*, 42*b* and 42*c* for sensing the outlet temperatures of the feed air and the inlet temperatures of the return gas within the cold end allowable values, they are deemed to be in a dead zone and no alteration is made in the reference control temperature. However, then there exists a reversing type heat exchanger in which the temperature difference of cold end sensed deviates from the cold end allowable values, then the reference control temperature is altered.

Figure 4:
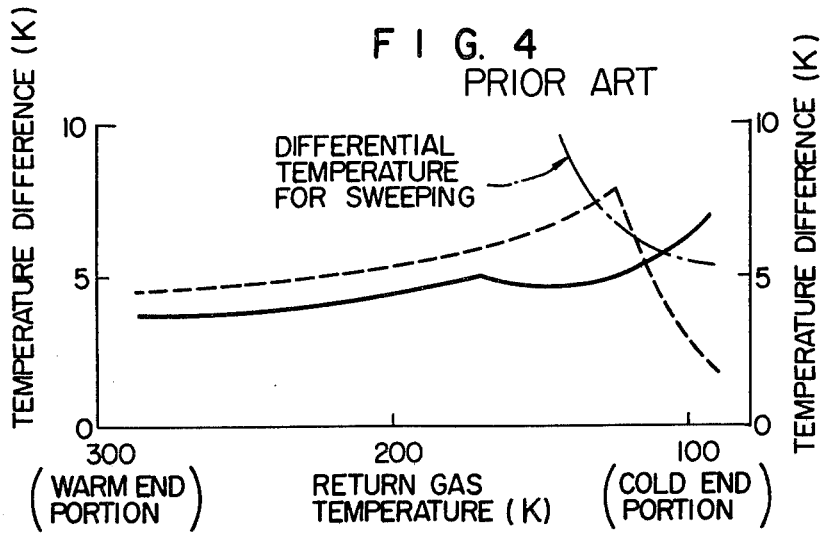
FIG. 4 PRIOR ART
FIG. 4 is a diagrammatic representation of the relationship between the temperature of the return gas and the temperature difference between the feed air and the return gas in various sections of the reversing type heat exchanger having a temperature differential of a cold end or temperature difference of a warm end.
Figure 7:
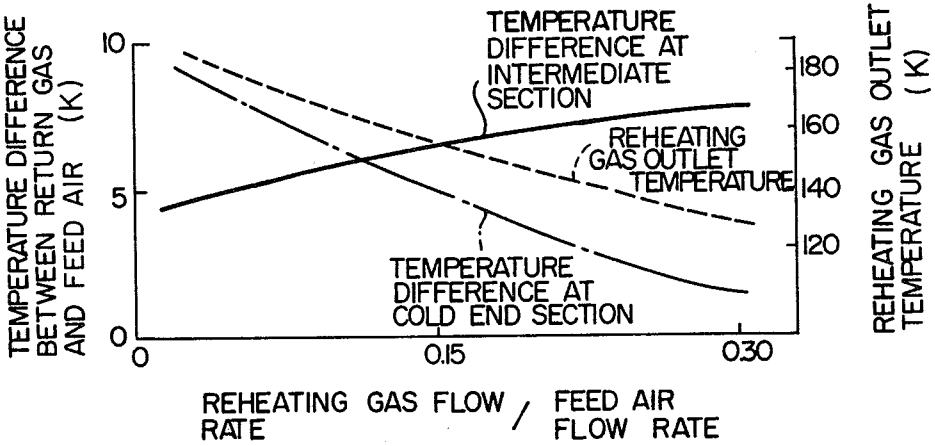
FIG. 7 is a diagrammatic representation of the relationship between the ratio of the reheating gas flow rate to the feed air flow rate, the output temperature of the reheating gas, and the temperature difference between the feed air and the return gas in the cold end portion and the intermediate portion of the reversing type heat exchanger.

When the cold end temperature of a reversing type heat exchanger exceeds the upper limit of the cold end allowable values or when the temperature difference of cold end exceeds the differential temperature for sweeping as indicated by a solid line in FIG. 4, it is necessary to effect adjustments in such a manner that, as shown in FIG. 7, the flow rate of the reheating gas is increased and the outlet temperature of the reheating gas is reduced, to thereby reduce the outlet temperature of the feed air and lower the temperature difference of cold end below the differential temperature for sweeping. When this is the case, the reference control temperature should be altered to a lower value.

When the temperature difference of cold end sensed is below the lower limit of the cold end allowable values or when, as indicated by a broken line in FIG. 4, the temperature difference between the feed air and the return gas in the intermediate section rises above the differential temperature for sweeping, it is necessary to effect adjustments in such a manner that the flow rate of the reheating gas is reduced to raise the outlet temperature of the reheating gas so as to reduce the temperature difference between the return gas and the feed air below the differential temperature for sweeping. When this is the case, the reference control temperature should be altered to a lower value.

When the temperature differences of cold end of the reversing type heat exchangers are found to balance as the result of sensing them, they are deemed to be in a dead zone. However, when the temperature differences of cold end of the reversing type heat exchangers do not balance as shown in FIG. 5, control is effected to obtain balancing of the temperature differences of cold end. To recover the heat satisfactorily in a plant, it is desirable that the plant be operated with a small value of the temperature differences of warm end of the reversing type heat exchangers. The temperature difference of cold end and the temperature difference of warm end show a specific tendency. Generally, the higher the temperature difference of cold end, the lower is the temperature difference of warm end. Thus, in the control method according to the invention, it is possible to effect control in a manner to bring the temperature differences of cold end of the reversing type heat exchangers into agreement with one another by adjusting the degree of opening of end product oxygen flow rate control valves 23*a*–23*c* by using as a reference temperature difference the temperature difference of cold end of the reversing type heat exchanger which is closest the differential temperature for sweeping of all the temperature differences of cold end of the reversing type heat exchangers.

In the embodiment of the temperature control method for the reversing type heat exchangers in conformity with the invention shown and described hereinabove, it is possible to obtain balancing of the outlet temperatures of the reheating gas of the reversing type heat exchanger group and also to control the temperature difference between the feed air and the return gas in various sections of the reversing heat exchanger group below differential temperature for sweeping at all times. Moreover, it is possible to effect temperature control in such a manner that the temperature differences of cold end of the reversing type heat exchangers can be balanced, so that it is possible to effectively remove by sweeping the dry ice deposited on the heat transfer surfaces of the channels which are cyclically switched and to effectively recover the heat with a high degree of efficiency. In the embodiment shown and described hereinabove, the air separation system has been described as having three reversing type heat exchangers arranged in parallel with one another. However, it is to be understood that the invention is not limited to this specific number of reversing type heat exchangers and that the invention can have application in any air separation system so long as at least two reversing type heat exchangers are arranged. The temperature difference of cold end has been used as a limit temperature of the sweeping conditions for carbon dioxide. However, there is no problem if the temperature difference of warm end for the sweeping conditions is used. Moreover, control has been described as being effected to bring the cold end temperatures of the reversing type heat exchangers into agreement with one another. However, control may be effected to bring the temperature differences of warm end into agreement with one another. In effecting control, other valves than the end product oxygen flow rate control valves 23*a*–23*c*, such as end product nitrogen flow rate control valves and feed air flow rate control valves, may have their degree of opening controlled.

From the foregoing description, it will be appreciated that according to the invention, there is provided a temperature control method for a reversing type heat exchanger group of an air separation system wherein in an arbitrarily selected reversing type heat exchanger of the reversing type heat exchanger group which serves as a reference for temperature control, a reference control temperature which is a reheating gas outlet temperature of the reversing type heat exchanger in which a temperature difference of cold end or a temperature difference of warm end is set to satisfy the differential temperature for sweeping between the temperature of feed air and the temperature of return gas, is compared with a reheating gas outlet temperature sensed in the reversing type heat exchanger serving as a reference, and the flow rate of the reheating gas of the reversing type heat exchanger serving as the reference is adjusted to bring the reheating gas outlet temperature into agreement with the reference control temperature; and in other reversing type heat exchangers, the reheating gas outlet temperature sensed in the reversing type heat exchanger serving as the reference which serves as a control target temperature is compared with reheating gas outlet temperatures sensed in other reversing type heat exchangers and adjustments of the flow rate of the reheating gas in other reversing type heat exchangers is effected in such a manner that the reheating gas outlet temperatures are brought into agreement with the control target temperature, to thereby obtain balancing of temperature in the reversing type heat exchanger group and effectively remove the ice and the dry ice deposited on a feed air channel by sweeping. Thus the invention enables a balancing of temperature in the reversing type heat exchanger group to be achieved an makes it possible to effectively remove by sweeping the ice and the dry ice deposited on the feed air channel. Moreover, according to the invention, the temperature difference of cold end or the temperature difference of warm end of each reversing type heat exchanger of the reversing type heat exchanger group is sensed, and the reference control temperature is altered in such a manner that the temperature difference of cold end of the reversing type heat exchanger in which the temperature difference of cold end is maximized or the temperature difference of cold end of the reversing type heat exchanger in which the temperature difference of warm end is minimized is brought to an optimum differential temperature for sweeping, and the flow rates of separated gases or the flow rate of the feed air for each reversing type heat exchanger is adjusted in such a manner that the temperature differences of cold end or temperature differences of warm end of the reversing type heat exchangers agree with one another, to thereby enable the heat to be efficiently recovered while obtaining stable operation of the reversing type heat exchanger group of the air separation system.

What is claimed is:

1. A temperature control method for a reversing type heat exchanger group of an air separation system wherein the reversing type heat exchanger group comprises at least two reversing type heat exchangers arranged in parallel with each other, each reversing type heat exchanger comprising a feed air channel, a return gas channel, separated gas channels, and a reheating gas channel of which the feed air channel can be cyclically switched, the flow rates of reheating gas flowing through the reversing type heat exchangers are regulated in such a manner that a temperature difference between feed air and return gas satisfies a sweeping temperature difference between the feed air and the return gas which allows dry ice deposited on the feed air channels of the reversing type heat exchangers to be effectively removed by sweeping, the temperature control method comprising the steps of:

regulating a flow rate of the reheating gas of one of said reversing type heat exchangers serving as a reference for effecting temperature control to bring an outlet temperature of the reheating gas to a value equal to that of a reference control temperature; and regulating the flow rates of the reheating gas of the other reversing type heat exchangers by using as a control target temperature the outlet temperature of the reheating gas regulating in said one reversing type heat exchanger serving as the temperature control reference, to thereby bring the outlet temperature of the reheating gas of the other reversing type heat exchangers to values equal to that of the control target temperature.

2. A temperature control method as claimed in claim 1, further comprising the steps of:

altering the reference control temperatures so as to bring a temperature difference of a cold end of the reversing type heat exchanger that has the highest temperature difference of the cold end in the reversing type heat exchanger group to a level of optimum sweeping temperature difference; and regulating the flow rate of the reheating gas and/or the flow-rate of the feed air of each of said reversing type heat exchangers to render the temperature differences of the cold end of all of the reversing type heat exchangers equal to one another.

3. A temperature control method as claimed in claim 1, further comprising the steps of:

altering the reference control temperature in such a manner that the temperature difference of the warm end of the reversing type heat exchanger that has the lowest temperature difference of the warm end in the reversing type heat exchanger group becomes equal to the warm end temperature at which the temperature difference of the cold end becomes equal to an optimum sweeping temperature difference; and regulating the flow rate of the separated gas and/or the flow rate of the feed air of each of said reversing type heat exchangers to render the temperature differences of the warm end of all the reversing type heat exchangers equal to one another.

* * * * *